United States Patent [19]

Hoenig et al.

[11] 4,337,874

[45] Jul. 6, 1982

[54] SNAP LOCK COVER END UNIT

[75] Inventors: James R. Hoenig, Tinley Park; Salvador C. Mallorca, Downers Grove, both of Ill.

[73] Assignee: The Continental Group, Inc., New York, N.Y.

[21] Appl. No.: 10,785

[22] Filed: Feb. 9, 1979

[51] Int. Cl.[3] ..... B65D 41/16; B65D 41/18

[52] U.S. Cl. ..... 220/306

[58] Field of Search ..... 220/306

[56] References Cited

U.S. PATENT DOCUMENTS

| | | | |
|---|---|---|---|
| 2,535,840 | 12/1950 | Coyle et al. | 220/306 |
| 3,463,349 | 8/1969 | Podesta et al. | 220/306 |
| 3,696,963 | 10/1972 | Saunders | 220/306 |

*Primary Examiner*—George T. Hall

*Attorney, Agent, or Firm*—Charles E. Brown

[57] ABSTRACT

A recloseable end unit for containers including an end ring securable to a container body and a removable cover. Both the end ring and the cover have terminal axial flanges terminating in curls, with the curls being directed in opposite directions and proportioned to snap past each other both during the removal of the cover and the replacement thereof.

3 Claims, 3 Drawing Figures

SNAP LOCK COVER END UNIT

This invention relates in general to new and useful improvements in end units for containers, and more particularly to end units of the type having a separately formed cover which is removable and replaceable again to seal the container after a portion of the product has been dispensed therefrom.

This invention particularly relates to an end unit of the type used in conjunction with one-gallon paint cans and includes a cover which is separately formed from the remainder of the end unit and is removable by means of a suitable tool, such as a screwdriver, and is replaceable by a snap interfit with the remainder of the end unit.

Most particularly, the end unit includes a ring having means on the outer periphery thereof for forming a seam with a container body and an innermost axial flange terminating in an outwardly directed curl, and there being a cover having a peripherally outer axial flange terminating in an inwardly directed curl, the sizes of the flanges being so proportioned that the curls will snap one over the other and then interlock behind each other so as both to retain the cover on the ring and to form a seal between the cover and the ring.

In accordance with this invention, the ring flange and the cover flange are both connected to their respective end unit portions by hinge-like connections so that when the curls are moved axially relative to each other the flanges may radially deflect to permit passage of the curls relative to each other.

If desired, the cover may have a gasket mounted on the interior thereof to form an effective seal with the ring curl.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
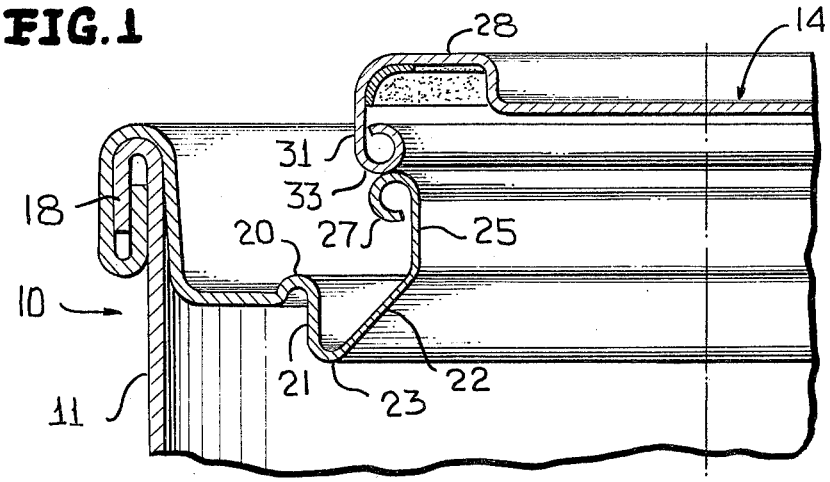
FIG. 1 is a fragmentary vertical sectional view taken through an upper portion of a container having an end unit in accordance with this invention, the cover thereof being in an adjacent removed position.

Referring now to the drawings in detail, it will be seen that there is illustrated a container, generally identified by the numeral 10, which includes a conventional container body 11 having the upper end thereof closed by an end unit which is the subject of this invention, the end unit being generally identified by the numeral 12.

The end unit 12 is of a two-piece construction and includes an outer end ring, generally identified by the numeral 13, and an inner cover, generally identified by the numeral 14. As will be developed hereinafter, the cover 14 is removable from the end ring 13 and is replaceable.

The end ring 13 is of an annular configuration and includes an end panel portion 15 which has connected to the outer periphery thereof a customary chuck wall 16 and a double seam forming portion 17 by means of which the end ring 13 is secured to the body 11 in sealed relation by way of a conventional type of double seam 18.

The inner peripheral edge of the end panel portion 15 terminates in an upstanding rib 20 from which an annular flange 21 depends. A sloping flange 22 extends upwardly and inwardly from a bend 23 which connects the flange 22 to the flange 21. It is to be noted that the flanges 21 and 22 define an annular channel 24, the function of which will be described hereinafter.

A terminal, axially extending flange 25 extends from and is connected to the upper end of the flange 22 by means of a bend 26. The flange 25 terminates in an outwardly and downwardly turned curl 27.

The cover 14 is particularly adapted to cooperate with the end ring 13 and includes an end panel 28 which, if desired, may have a recessed central portion 30. The end panel 28 is connected to a downwardly directed axial flange 31 by a curved portion 32 with the flange 31 being a terminal flange. The free end of the terminal flange 31 carries a radially inwardly and axially upwardly turned curl 33.

At this time it is also pointed out that the cover 14 may be provided with a gasket 34 which is mounted within the rounded corner defined by the curved portion 32 and the adjacent portions of the end panel 28 and the flange 31. The gasket 34 may or may not be utilized, depending upon the product which is to be packaged within the container 10.

Figure 3:
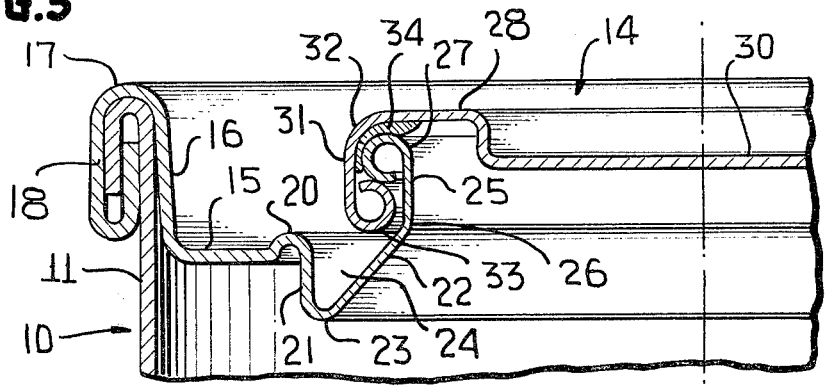
FIG. 3 is a sectional view similar to FIG. 1, and shows the cover in a container closing position.

Referring now to FIG. 3 in particular, it will be seen that when the cover 14 is in place relative to the end ring 13, the curl 33 underlies the curl 27 and the curl 27 is disposed in the corner in compressive sealed engagement with the gasket 34. It is to be understood that both the curl 27 and the curl 33 are compressed to provide a spring-like retention of the cover 14 which provides for the positive compressive engagement of the gasket 34 with the curl 27.

It is also to be noted that the relative diameters of the flanges 25 and 31 is such that there is a radial compression between that portion of the gasket 34 overlying the flange 31 and the adjacent portion of the curl 27. At the same time the curl 33 is spaced radially outwardly of the flange 25. If the gasket 34 is not employed, the relative diameters of the flanges 25 and 31 as well as the relative axial extent of these flanges would be such that the thickness of the gasket 34 would be compensated for and the curl 27 would directly compressively engage in the corner of the cover 14 so as effectively to form a direct seal. The curl 27 would be in compressive engagement in a radial direction with the flange 31.

Figure 2:
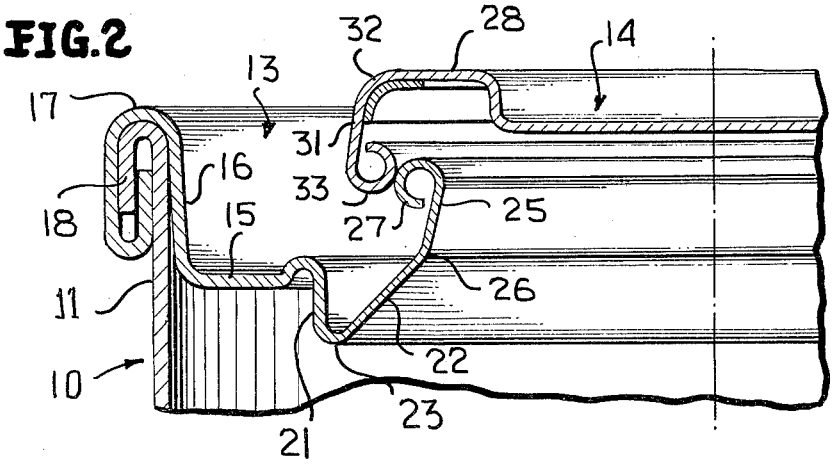
FIG. 2 is a sectional view similar to FIG. 1, and shows the cover in intermediate position.

As is clearly shown in FIG. 1, the relative dimensions of the curls 27 and 33 is such that when the cover 14 is lightly seated on the end ring 13, the curl 33 will rest on the curl 27. When the cover 14 is pressed axially downwardly, the curved surfaces of the curls 27 and 33 will provide a camming action forcing the curl 33 radially outwardly and the curl 27 radially inwardly, as shown in FIG. 2. It is to be noted that in order for this relative deflection of the curls to occur, the flange 31 must hinge relative to the end panel 28 with the curved portion 32 functioning as hinge means. In a like manner, the flange 25 must hinge relative to the remainder of the end ring 13 with generally the bend 26 forming the hinge means.

As the curl 33 moves downwardly below the curl 27, the inherent resiliency of both the end ring 13 and the cover 14 will result in the flanges 25 and 31 snapping back to their original contour of FIG. 1, with the curl 33 snapping radially inwardly and axially below the curl 27 to the position of FIG. 3 wherein the cover 14 is not only retained in place on the end ring 13, but also forms a seal therewith.

It is to be understood that the cover 14 may be removed by placing a suitable tool beneath the curl 33 and prying the curl 33 upwardly until it snaps over the curl 27.

The end unit 12 is particularly adapted, but not limited, for use in paint cans and the like. When the product packaged within the container 10 is a liquid, the channel 24 defines a collection area into which the draining product which results from the pouring of the product may be collected and from which it may be suitably removed.

Although only a preferred embodiment of the end unit has been specifically illustrated and described herein, it is to be understood that minor variations may be made in the end unit without departing from the spirit and scope of the invention as defined by the appended claims.

We claim:

1. A recloseable end unit for containers, said end unit comprising an end ring having means on an outer periphery thereof for attachment to a container body, said ring having an inner terminal upstanding axial flange terminating in an outwardly directed curl, and a removable cover, said cover including an end panel and an outer terminal depending axial flange terminating in an outwardly directed curl, said axial flanges being in telescoped relation with said ring curl being axially outwardly and radially inwardly compressively engaged between said end panel and said cover curl, said cover axial flange being connected to said end panel in a rounded corner, and said ring curl is seated in said rounded corner, said ring including an end panel portion, and hinge means mounting said ring flange on said end panel portion for facilitating radial inward deflection of said ring flange and ring curl during positioning and removal of said cover, said ring hinge means including an axially outwardly opening channel portion and a bend connecting said ring flange to a radial inner edge of said channel portion.

2. The end unit of claim 1 wherein a radial outer edge of said channel portion is connected to said ring by an upstanding rib.

3. A recloseable end unit for containers, said end unit comprising an end ring having means on an outer periphery thereof for attachment to a container body, said ring having an inner terminal upstanding axial flange terminating in an outwardly directed curl, and a removable cover, said cover including an end panel and an outer terminal depending axial flange terminating in an outwardly directed curl, said axial flanges being in telescoped relation with said ring curl being axially outwardly and radially inwardly compressively engaged between said end panel and said cover curl, said cover axial flange being connected to said end panel in a rounded corner, and said ring curl is seated in said rounded corner, said ring including an end panel portion, and hinge means mounting said ring flange on said end panel portion for facilitating radial inward deflection of said ring flange and ring curl during positioning and removal of said cover, a radial outer edge of said channel portion being connected to said ring by an upstanding rib.

* * * * *